US007221342B2

(12) United States Patent
Fish

(10) Patent No.: US 7,221,342 B2
(45) Date of Patent: May 22, 2007

(54) ELECTROLUMINESCENT DISPLAY DEVICE

(75) Inventor: David Andrew Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 159 days.

(21) Appl. No.: 10/507,183

(22) PCT Filed: Feb. 7, 2003

(86) PCT No.: PCT/IB03/00524

§ 371 (c)(1),
(2), (4) Date: Sep. 9, 2004

(87) PCT Pub. No.: WO03/077230

PCT Pub. Date: Sep. 18, 2003

(65) Prior Publication Data

US 2005/0151705 A1 Jul. 14, 2005

(30) Foreign Application Priority Data

Mar. 13, 2002 (GB) ..... 0205859.2

(51) Int. Cl.
*G09G 3/30* (2006.01)

(52) U.S. Cl. ..... 345/80; 345/205

(58) Field of Classification Search ..... 345/76, 345/80, 82, 204–206, 208–215; 315/169.3; 340/FOR. 281, FOR. 282
See application file for complete search history.

(56) References Cited

U.S. PATENT DOCUMENTS

| | | | | |
|---|---|---|---|---|
| 6,356,029 | B1 * | 3/2002 | Hunter | 315/169.1 |
| 6,650,060 | B2 * | 11/2003 | Okuda | 315/169.1 |
| 6,734,836 | B2 * | 5/2004 | Nishitoba | 345/82 |
| 6,859,193 | B1 * | 2/2005 | Yumoto | 345/82 |

FOREIGN PATENT DOCUMENTS

| | | |
|---|---|---|
| EP | 0717446 A2 | 6/1996 |
| WO | WO 96/36959 | 11/1996 |
| WO | WO 99/65012 | 12/1999 |

* cited by examiner

*Primary Examiner*—Amr A. Awad
*Assistant Examiner*—Tom Sheng
(74) *Attorney, Agent, or Firm*—Aaron Waxler; Paul Im

(57) ABSTRACT

An active matrix electroluminescent (EL) display device has a switching circuit for each display pixel which has a drive transistor (30) and a cascode transistor (32) in series with the associated EL display element (20). The switching circuit is operable in two modes, a first mode in which an input current is sampled by the drive transistor (30) and a second mode in which the drive transistor drives a current corresponding to the input current through the EL display element (20). This configuration uses the same transistor for current sampling as for current driving, thereby avoiding the need for matched transistors. The cascode transistor increases the output impedance and ensures that no voltage fluctuations pass to the drive transistor, so that a constant current supply is maintained.

10 Claims, 3 Drawing Sheets

ELECTROLUMINESCENT DISPLAY DEVICE

The invention relates to electroluminescent display devices, for example using organic LED devices such as polymer LEDs.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. An example of such is described in an article by D. Braun and A. J. Heeger in Applied Physics Letters 58(18) p.p. 1982-1984 (6 May 1991).

The polymer material can be fabricated using a CVD process, or simply by a spin coating technique using a solution of a soluble conjugated polymer. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Organic electroluminescent materials offer advantages in that they are very efficient and require relatively low (DC) drive voltages. Moreover, in contrast to conventional LCDs, no backlight is required.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

In this way, the display elements are integrated into an active matrix, whereby each display element has an associated switching circuit which is operable to supply a drive current to the display element so as to maintain its light output for a significantly longer period than the row address period. Thus, for example, each display element circuit is loaded with an analogue (display data) drive signal once per field period in a respective row address period, which drive signal is stored and is effective to maintain a required drive current through the display element for a field period until the row of display elements concerned is next addressed.

An example of such an active matrix addressed electroluminescent display device is described in EP-A-0717446. The conventional kind of active matrix circuitry used in LCDs cannot be used with electroluminescent display elements as such display elements need to continuously pass current in order to generate light whereas the LC display elements are capacitive and therefore take virtually no current and allow the drive signal voltage to be stored in the capacitance for the whole field period. In EP-A-0717446, each switching circuit comprises two TFTs (thin film transistors) and a storage capacitor. The anode of the display element is connected to the drain of the second TFT and the first TFT is connected to the gate of the second TFT which is connected also to one side of the capacitor. During a row address period, the first TFT is turned on by means of a row selection (gating) signal and a drive (data) signal is transferred via this TFT to the capacitor.

After the removal of the selection signal the first TFT turns off and the voltage stored on the capacitor, constituting a gate voltage for the second TFT, is responsible for operation of the second TFT which is arranged to deliver electrical current to the display element. The gate of the first TFT is connected to a gate line (row conductor) common to all display elements in the same row and the source of the first TFT is connected to a source line (column conductor) common to all display elements in the same column. The drain and source electrodes of the second TFT are connected to the anode of the display element and a ground line which extends parallel to the source line and is common to all display elements in the same column. The other side of the capacitor is also connected to this ground line.

The active matrix structure is fabricated on a suitable transparent, insulating, support, for example of glass, using thin film deposition and process technology similar to that used in the manufacture of AMLCDs.

With this arrangement, the drive current for the light-emitting diode display element is determined by a voltage applied to the gate of the second TFT. This current therefore depends strongly on the characteristics of that TFT. Variations in threshold voltage, mobility and dimensions of the TFT will produce unwanted variations in the display element current, and hence its light output. Such variations in the second TFTs associated with display elements over the area of the array, or between different arrays, due, for example, to manufacturing processes, lead to non-uniformity of light outputs from the display elements.

In order to address this issue, WO 99/65012 discloses a pixel circuit in which each switching circuit comprises a current mirror circuit which operates to sample and store a current drive signal, and to apply the sampled drive signal to an identical pixel drive transistor. This circuit improves the uniformity of the light output, by ensuring that the currents driving the display elements are not subject to the effects of variations in the characteristics of individual transistors supplying the currents. The matching of the current sampling transistor and the pixel drive transistor is assumed as they are formed over adjacent areas of the substrate, so that variations over the area of the substrate can be ignored.

An alternative current mirror circuit in which matching of the current sampling transistor and the drive transistor is not required is disclosed in WO 99/60511. In this circuit, a current mirror circuit is implemented in which the same transistor is used to both sense and later produce the required drive current for the display element. This allows all variations in transistor characteristics to be compensated.

In both of these circuits, an input current is sampled and converted into a gate voltage, which is stored. The gate voltage stored as a result of the current sampling operation can be subject to variation as a result of TFT parasitic capacitances. This effect is known as "kick back".

Furthermore, the finite output impedance of the current providing transistor in the current mirror circuits provides a limitation.

According to the present invention, there is provided an active matrix electroluminescent (EL) display device comprising a matrix array of electroluminescent display elements each of which has an associated switching circuit for controlling the current through the display element in accordance with an applied drive signal, wherein the switching circuit comprises:

a drive transistor and a cascode transistor in series with an associated EL display element, the drive transistor being for driving a current through the associated EL display element;

a storage capacitor connected between a power supply line and the gate of the drive transistor, for storing a gate voltage for the drive transistor;

a first switch for allowing or preventing the drive current to flow through the EL display element, wherein the switching circuit is operable in two modes, a first mode in which an input current is sampled by the drive transistor and the first switch is open, and a second mode in which the drive transistor drives a current corresponding to the input current through the EL display element, and the first switch is closed.

This configuration uses the same transistor for current sampling as for current driving, thereby avoiding the need for matched transistors. The cascode transistor increases the output impedance and ensures that no voltage fluctuations pass to the drive transistor, so that a constant current supply is maintained. Thus, the effect of kickback is minimised.

A second switch is preferably provided between the gate and drain of the drive transistor, for diode-connecting the drive transistor during the current sampling mode. This second switch may comprise an n-channel transistor and a p-channel transistor in parallel switched simultaneously, to reduce the effect of charge transfer when the switch is turned off (when switching from the first to the second mode).

A third switch is preferably provided between the gate and drain of the cascode transistor, for diode connecting the cascode transistor during the current sampling mode. A second storage capacitor is also connected between the gate of the cascode transistor and the power supply line for holding the cascode transistor on during the second mode.

A fourth switch is preferably provided between the drain of the cascode transistor and a current input to the switching circuit, and acts as an input switch for the input current.

In one version, the first switch is connected between the cascode transistor and the associated display element, and in this way one first switch is provided for each switching circuit. However, the first switch can be connected between the associated display element and a second power supply line, which is common to all display elements of the device. In this way, the first switch can be shared between all display elements, thereby reducing the number of transistors in each individual pixel switching circuit.

The display elements are preferably arranged in rows and columns, and the switches of the switching circuit for a row of display elements are connected to a respective, common, row address conductor via which a selection signal for operating the switches in that row is supplied, and each row address conductor is arranged to receive a selection signal in turn, whereby the rows of display elements are addressed one at a time in sequence.

Embodiments of active matrix electroluminescent display devices in accordance with the invention will now be described, by way of example, with reference to the accompanying drawings, in which.

The figures are merely schematic and have not been drawn to scale. The same reference numbers are used throughout the figures to denote the same or similar parts.

Figure 1:
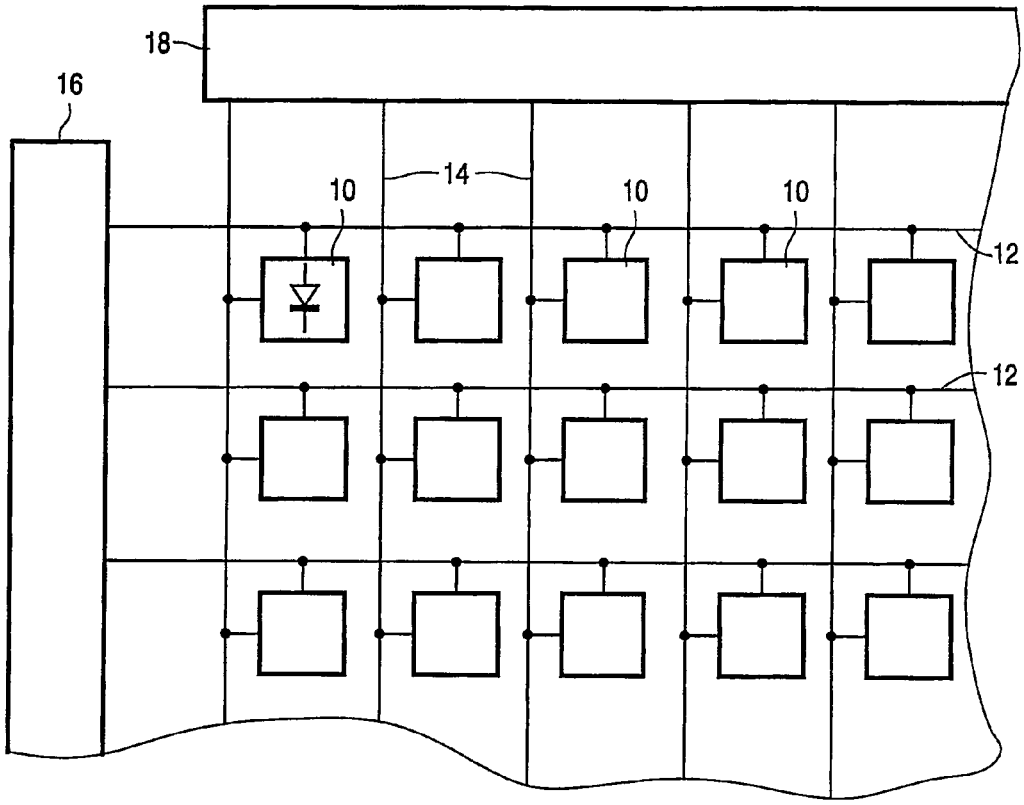
FIG. 1 is a simplified schematic diagram of part an embodiment of display device according to the invention.

Referring to FIG. 1, the active matrix addressed electroluminescent display device comprises a panel having a row and column matrix array of regularly-spaced pixels, denoted by the blocks 10 and comprising electroluminescent display elements together with associated switching circuits, located at the intersections between crossing sets of row (selection) and column (data) address conductors, or lines, 12 and 14. Only a few pixels are shown in the Figure for simplicity. In practice there may be several hundred rows and columns of pixels. The pixels 10 are addressed via the sets of row and column address conductors by a peripheral drive circuit comprising a row, scanning, driver circuit 16 and a column, data, driver circuit 18 connected to the ends of the respective sets of conductors.

Figure 2:
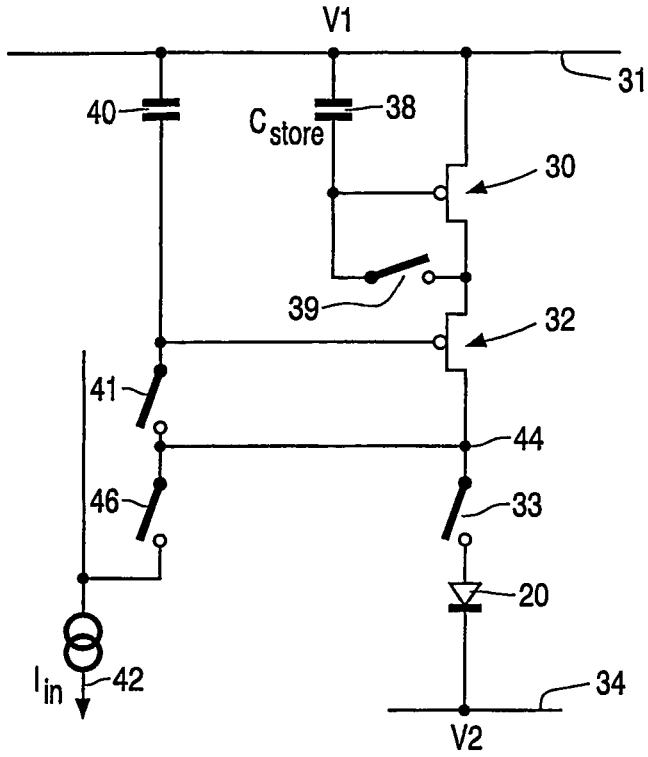
FIG. 2 shows in simple form the equivalent circuit of a typical pixel circuit comprising a display element and its associated control circuitry in the display device of FIG. 1.
Figure 3:
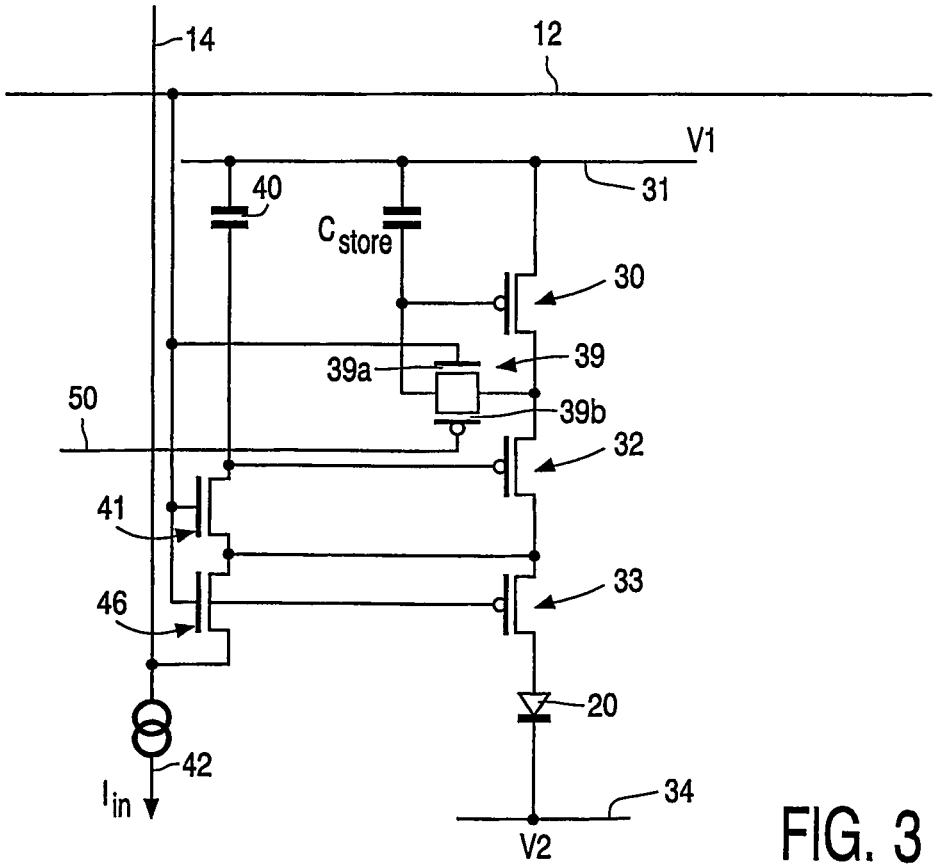
FIG. 3 illustrates a practical realisation of the pixel circuit of FIG. 2.

FIG. 2 shows in simplified schematic form the circuit of a typical pixel block 10 in accordance with the invention and is intended to illustrate the basic manner of its operation. A practical implementation of the pixel circuit of FIG. 2 is illustrated in FIG. 3.

The electroluminescent display element, referenced at 20, comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 20 closest to the substrate may consist of a transparent conductive material such as ITO so that light generated by the electroluminescent layer is transmitted through these electrodes and the support so as to be visible to a viewer at the other side of the support. In this particular embodiment, however, the light output is intended to be viewed from above the panel and the display element anodes comprise parts of a continuous ITO layer 22 connected to a potential source and constituting a second supply line common to all display elements in the array and held at a fixed reference potential. The cathodes of the display elements comprise a metal having a low work-function such as calcium or a magnesium: silver alloy. Typically, the thickness of the organic electroluminescent material layer is between 100 nm and 200 nm. Typical examples of suitable organic electroluminescent materials which can be used for the elements 20 are described in EP-A-0 717446 to which reference is invited for further information and whose disclosure in this respect is incorporated herein. Electroluminescent materials such as conjugated polymer materials described in WO96/36959 can also be used.

Each display element 20 has an associated switch circuit which is connected to the row and column conductors 12 and 14 adjacent the display element and which is arranged to operate the display element in accordance with an applied analogue drive (data) signal level that determines the element's drive current, and hence light output (grey-scale). The display data signals are provided by the column driver circuit 18 which acts as a current sink. A suitably processed video signal is supplied to this circuit which samples the video signal and applies a current constituting a data signal related to the video information to each of the column conductors in a manner appropriate to row at a time addressing of the array with the operations of the column driver circuit and the scanning row driver circuit being synchronised.

Referring to FIG. 2, the switch circuit comprises a drive transistor 30, more particularly a p-channel FET, whose first current-carrying (source) terminal is connected to a supply line 31 and whose second current-carrying (drain) terminal is connected, to a first current-carrying terminal (source) of a cascode transistor 32. The second current-carrying terminal (drain) of the cascode transistor 32 is connected, via a switch 33, to the anode of the display element 20. The anode of the display element is connected to a second supply line 34, which in effect is constituted by the continuous electrode layer held at a fixed reference potential.

The gate of the drive transistor 30 is connected to the supply line 31, and hence the source electrode, via a storage capacitance 38 which may be a separately formed capacitor or the intrinsic gate-source capacitance of the transistor. The gate of the drive transistor 30 is also connected via a switch 39 to its drain terminal.

The gate of the cascode transistor 32 is also connected to the supply line 31 via a storage capacitance 40, and the gate of the cascode transistor 32 is also connected via a switch 41 to its drain terminal.

The transistor circuit operates in the manner of a single transistor current mirror with the same transistor performing both current sampling and current output functions and with the display element 20 acting as the load. The output of the switching circuit defines a cascode current mirror circuit.

An input to this current mirror circuit is provided by an input line 42 which connects to a node 44 between the cascode transistor 32 and the switch 33, via a further switch 46 which controls the application of an input signal to the node.

Operation of the circuit takes place in two phases. In a first, sampling, phase, corresponding in time to an addressing period, an input signal for determining a required output from the display element is drained from the circuit and a consequential gate-source voltage on the drive transistor 30 is sampled and stored in the capacitance 38. In a subsequent, output, phase the drive transistor 30 operates to draw current through the display element 20 according to the level of the stored voltage so as to produce the required output from the display element, as determined by the input signal, which output is maintained for example until the display element is next addressed in a subsequent, new, sampling phase. During both phases it is assumed that the supply lines 31 and 34 are at appropriate, pre-set, potential levels, V1 and V2. In this configuration, the supply line 31 will normally be at a positive potential (V1) and the supply line 34 will be at ground (V2).

During the sampling phase, the switches 39, 41 and 46 are closed, which diode—connects the drive transistor 30 and the cascode transistor 32, and couples the input 42 to the node 44. The switch 33 is open, which isolates the display element load. An input signal, corresponding to the required display element current and denoted here as lin, is driven through the drive transistor 30 and the cascode transistor 32 from an external source, e.g. the column driver circuit 18 in FIG. 1, via the input line 42, the closed switch 46 and the input terminal 44. Because the drive transistor 30 is diode—connected by virtue of the closed switch 39, the voltage across the capacitance 38 at the steady state condition will be the gate-source voltage that is required to drive a current lin through the channel of the drive transistor 30. Having allowed sufficient time for this current to stabilise, the sampling phase is terminated upon the opening of the switches 39, 41 and 46, isolating the input terminal 44 from the input line 42 and isolating the capacitances 38 and 40 so that the gate-source voltage, for the drive transistor determined in accordance with the input signal lin, is stored in the capacitance 38. Similarly, the gate voltage for the cascode transistor 32 is stored on the isolated capacitance 40 to keep the cascode transistor turned on and able to pass the source-drain current of the drive transistor 30.

The output phase then begins upon the closing of the switch 33, thus connecting the display element anode to the drain of the cascode transistor 32. The drive transistor 30 then operates as a current source and a current approximately equal to lin is drawn through the cascode transistor 32 and the display element 20.

The cascode operation essentially holds the source-drain voltage across the drive transistor 30 substantially constant (because the gate of the cascode transistor is held constant by the capacitor 40), and in this way the circuit has minimal kickback, as well as high output impedance achieved by the cascade transistor.

Because the same transistor is used to sample lin during the sampling phase and to generate the current during the output phase, the display element current is not dependent on the threshold voltage or the mobility of the transistor 30.

FIG. 3 shows a practical embodiment of the pixel circuit of FIG. 2 used in the display device of FIG. 1. In this, the switches 33, 41 and 46 are each constituted by transistors and these switching transistors, together with the drive transistor 30 and the cascode transistor 32, are all formed as thin film field effect transistors, TFTs. The input line 42, and the corresponding input lines of all pixel circuits in the same column, are connected to a column address conductor 14 and through this to the column driver circuit 18.

The gates of the transistors 33, 41 and 46, and likewise the gates of the corresponding transistors in pixel circuits in the same row, are all connected to the same row address conductor 12. The transistors 41 and 46 comprise n-channel devices and are turned on (closed) by means of a selection (scan) signal in the form of a voltage pulse applied to the row address conductor 12 by the row driver circuit 16. The transistor 33 is of opposite conductivity type, comprising a p-channel device, and operates in complementary fashion to the transistors 41 and 46 so that it turns off (opens) when the transistors 41 and 46 are closed in response to a selection signal on the conductor 12, and vice versa.

As shown in FIG. 2, the switch 39 is implemented as two transistors in parallel. The first 39*a* is an n-channel device which is also turned on by the voltage pulse applied to the row address conductor 12, so that during the sampling phase, the switch is closed to diode-connect the drive transistor 30. A second transistor 39*b* is a p-channel device and is turned on or off by an external control signal applied to terminal 50. This additional transistor is provided to prevent kickback onto the storage capacitor 38 via the addressing voltages.

The transistors 39*a* and 39*b* are turned on and off at the same time. If these n and p type transistors are sized correctly then their parasitic capacitances will be equal (namely the capacitance between the gate of each transistor and the storage capacitor). This has the effect of cancelling kickback from the two transistors.

The supply line 34 extends as an electrode parallel to the row conductor 12 and is shared by all pixel circuits in the same row. The supply lines 34 of all rows can be connected together at their ends. The supply lines may instead extend in the column direction with each lines then being shared by the display elements in a respective column. Alternatively, supply lines may be provided extending in both the row and column directions and interconnected to form a grid structure.

The array is driven a row at a time in turn with a selection signal being applied to each row conductor 12 in sequence. The duration of the selection signal determines a row address period, corresponding to the period of the sampling phase. In synchronisation with the selection signals, appropriate input current drive signals, constituting data signals, are applied to the column conductors 14 by the column driver circuit 18 as required for a row at a time addressing so as to set all the display elements in a selected row to their required drive level simultaneously in a row address period with a respective input signals determining the required display outputs from the display elements. Following addressing of a row in this way, the next row of display elements is addressed in like manner. After all rows of display elements have been addressed in a field period the address sequence is repeated in subsequent field periods with the drive current for a given display element, and hence the output, being set in the respective row address period and maintained for a field period until the row of display elements concerned is next addressed.

The matrix structure of the array, comprising the TFTs, the sets of address lines, the storage capacitors (if provided as discrete components), the display element electrodes and their interconnections, is formed using standard thin film processing technology similar to that used in active matrix LCDs which basically involves the deposition and patterning of various thin film layers of conductive, insulating and semiconductive materials on the surface of an insulating support such as glass or plastics material by CVD deposition and photolithographic patterning techniques. An example of such is described in EP-A-0717446. The TFTs may comprise amorphous silicon or polycrystalline silicon TFTs. The organic electroluminescent material layer of the display elements may be formed by vapour deposition or by another suitable known technique, such as spin coating.

Figure 4:
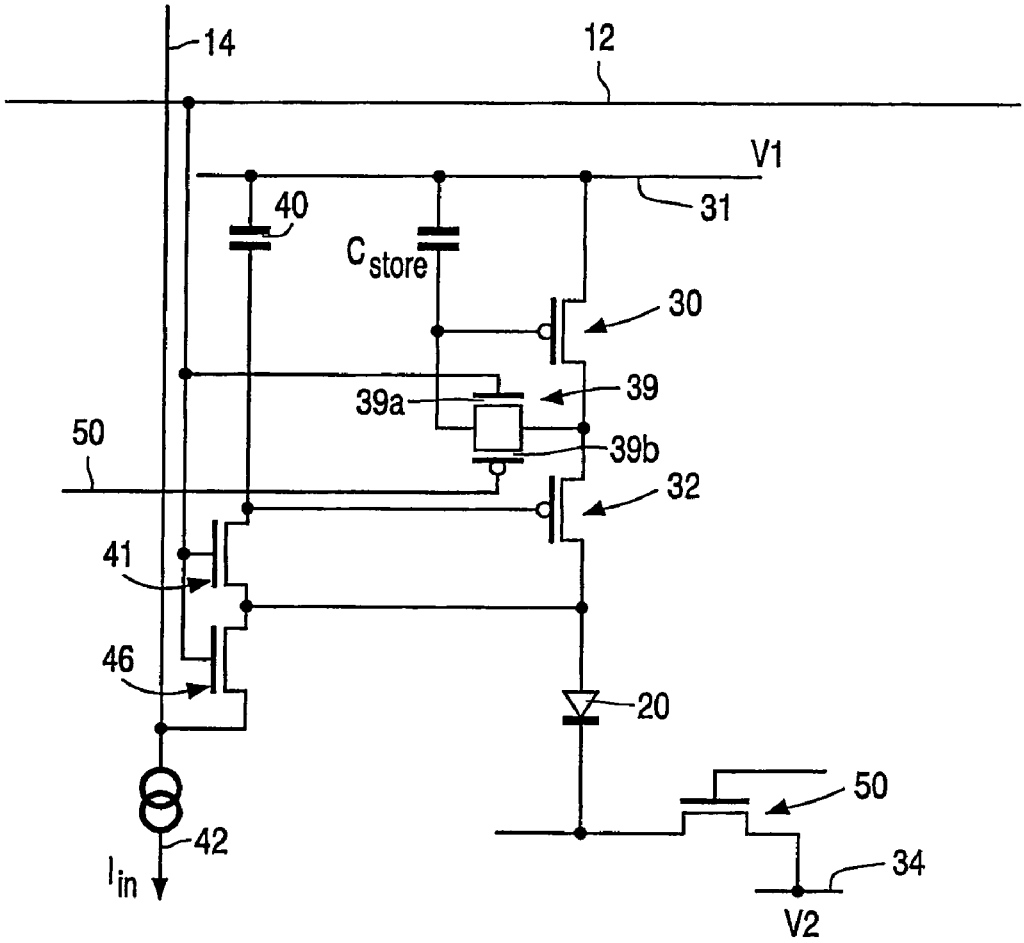
FIG. 4 shows a modified form of the pixel circuit.

FIG. 4 illustrates an alternative, modified, form of pixel circuit which reduces the number of transistors required in each pixel.

In this circuit, the transistor 33 is removed and the input terminal 44 is connected directly to the display element 20. The cathode of the display element is instead coupled through a transistor 50 to the supply line 34 (for example earth). A single transistor 50 is provided for the entire display.

As with the previous circuit there are two phases, sampling and output, in the operation of the current mirror. However, all pixels in the display will be subjected to the sampling phase before the cathode is connected to earth. For example, addressing will occur over ⅔ of a field period with the cathode disconnected, then the cathode is connected, with no further addressing, and the display is lit for the remaining ⅓ of the field period. This will require an increased output intensity, as the address period is reduced, but this approach has the advantage of reducing the sample and hold effect. When an image is held static for the full field period, moving images can appear blurred, and this is known as the sample and hold effect.

The increased output impedance will be particularly beneficial for so-called "upward emission" LED devices, in which a transparent cathode is provided. This will be a resistive contact, and the increased output impedance of the cascode current source enables more accurate current drive.

It will be appreciated that although the pixel circuits described above are based on a p-channel drive transistor 30 and cascode transistor 32, the same modes of operation are possible if the polarity of these transistors is reversed, the display element polarity is reversed, and the polarity of the pulses applied to the supply lines and row conductors are reversed. Where n-type transistors are used (39*a*, 41, 46), these would become p-type.

There may be technological reasons for preferring one or other orientation of the diode display elements so that a display device using p-channel transistors as shown may be desirable. For example, the material required for the cathode of a display element using organic electroluminescent material would normally have a low work function and typically would comprise a magnesium-based alloy or calcium. Such materials tend to be difficult to pattern photolithographically and hence a continuous layer of such material common to all display elements in the array may be preferred.

It is envisaged that instead of using thin film technology to form the TFTs and capacitors on an insulating substrate, the active matrix circuitry could be fabricated using IC technology on a semiconductor, for example, silicon, substrate. The upper electrodes of the LED display elements provided on this substrate would then be formed of transparent conductive material, e.g. ITO, with the light output of the elements being viewed through these upper electrodes. These are the "upward emission" LEDs mentioned above.

It is envisaged also that the switches in the circuit need not comprise transistors but may comprise other types of switches, for example, micro-relays, micro-switches or transmission gate switches.

Although the above embodiments have been described with reference to organic electroluminescent display elements in particular, it will be appreciated that other kinds of electroluminescent display elements comprising electroluminescent material through which current is passed to generate light output may be used instead.

The display device may be a monochrome or multi-color display device. It will be appreciated that a colour display device may be provided by using different light colour emitting display elements in the array. The different colour emitting display elements may typically be provided in a regular, repeating pattern of, for example, red, green and blue colour light emitting display elements.

From reading the present disclosure, other modifications will be apparent to persons skilled in the art. Such modifications may involve other features which are already known in the field of matrix electroluminescent displays and component parts thereof and which may be used instead of or in addition to features already described herein.

The invention claimed is:

1. An active matrix electroluminescent (EL) display device comprising a matrix array of electroluminescent display elements each of which has an associated switching circuit for controlling the current through the display element in accordance with an applied drive signal, wherein the switching circuit comprises:

a drive transistor and a cascode transistor in series with an associated EL display element, the drive transistor being for driving a current through the associated EL display element and the cascode transistor being connected between the drive transistor and the associated EL display element;

a storage capacitor connected between a power supply line to which the source of the drive transistor is also directly connected and the gate of the drive transistor, for storing a gate voltage for the drive transistor; and a first switch for allowing or preventing the drive current to flow through the EL display element, wherein the first switch is connected between the cascode transistor and the associated display element;

wherein the switching circuit is operable in two modes, a first mode in which an input current is sampled by the drive transistor and the first switch is open, and a second mode in which the drive transistor drives a current corresponding to the input current through the EL display element, and the first switch is closed.

2. A device as claimed in claim 1, further comprising a second switch between the gate and drain of the drive transistor.

3. A device as claimed in claim 2, wherein the second switch comprises an n-channel transistor and a p-channel transistor in parallel.

4. A device as claimed in claim 1, 2, or 3 further comprising a third switch between the gate and drain of the cascode transistor.

5. A device as claimed in claim 1, 2, or 3 further comprising a second storage capacitor connected between the gate of the cascode transistor and the power supply line.

6. A device as claimed in claim 1, 2, or 3 further comprising a fourth switch between the drain of the cascode transistor and a current input to the switching circuit.

7. A device as claimed in claim 1, 2, or 3 wherein the first switch is connected between the associated display element and a second power supply line, which is common to all display elements of the device.

8. A device as claimed in claim 1, 2 or 3 wherein the display elements are arranged in rows and columns, and said switch or switches of the switching circuit for a row of display elements are connected to a respective, common, row address conductor via which a selection signal for operating the switches in that row is supplied, and each row address conductor is arranged to receive a selection signal in turn, whereby the rows of display elements are addressed one at a time in sequence.

9. A device as claimed in claim 8, wherein the drive signals for the display elements in a column are supplied via a respective column address conductor common to the display elements in the column, the input current being supplied to or drained from the column address conductor.

10. A device according to claim 1, 2, or 3, wherein the drive transistor, the cascode transistor and the switch or switches comprise thin film transistors carried on an insulating substrate.

* * * * *